US006632327B1

(12) United States Patent
Shall

(10) Patent No.: US 6,632,327 B1
(45) **Date of Patent: *Oct. 14, 2003**

(54) PROCESS FOR TREATING SPENT, WASTE, ALKALINE DIGESTION LIQUOR FROM PAPER PULPING OPERATIONS AND PRODUCT

(75) Inventor: Hassan El Shall, Gainsville, FL (US)

(73) Assignee: Bountiful Applied Research Corporation, Bountiful, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/424,721

(22) PCT Filed: May 29, 1997

(86) PCT No.: PCT/US97/09418

§ 371 (c)(1),
(2), (4) Date: Nov. 29, 1999

(87) PCT Pub. No.: WO98/54400

PCT Pub. Date: Dec. 3, 1998

Related U.S. Application Data

(63) Continuation-in-part of application No. 08/109,241, filed on Aug. 20, 1993, now Pat. No. 5,635,024.

(51) Int. Cl.[7] ..... D21C 11/10

(52) U.S. Cl. ..... 162/29; 162/16; 162/30.11; 210/705; 210/724

(58) Field of Search ..... 162/292, 16; 210/705, 210/724, 725, 928, 917, 734

(56) References Cited

U.S. PATENT DOCUMENTS

| | | | | |
|---|---|---|---|---|
| 4,724,045 A | * | 2/1988 | Ackel | 162/29 |
| 4,921,613 A | * | 5/1990 | Nordberg et al. | 210/651 |
| 5,632,857 A | * | 5/1997 | Larson | 162/5 |
| 5,635,024 A | * | 6/1997 | Shall | 162/16 |
| 6,039,189 A | * | 3/2000 | Luke | 209/5 |

FOREIGN PATENT DOCUMENTS

| | | | |
|---|---|---|---|
| CN | 106128 A | | 4/1992 |
| EP | 486574 | * | 8/1990 |
| JP | 66015248 | * | 6/1968 |

OTHER PUBLICATIONS

"Production of Lignin from the Organocell Pulping Process", Zitzelsberger, W., 1991, Mitt. Bund..Forst–Holzwirthsch. No. 168:15–21.*

* cited by examiner

*Primary Examiner*—Dean T. Nguyen
(74) *Attorney, Agent, or Firm*—Mallinckrodt & Mallinckrodt; Robert R. Mallinckrodt

(57) ABSTRACT

A water soluble, surface active, polymeric agent is mixed with digestion liquor, preferably with an additional surface active defoamer coagulant agent prior to or during acidification of the alkaline digestive liquor. This results in an easily separable, non-gelatinous, non-gummy, coagulated lignin as a solids, particulate fraction that tends to float on a clarified liquid fraction containing recoverable salts. The solids fraction and the liquid frictions are easily separated, one from the other, by a gravity separation step.

14 Claims, 3 Drawing Sheets

Figure 1:
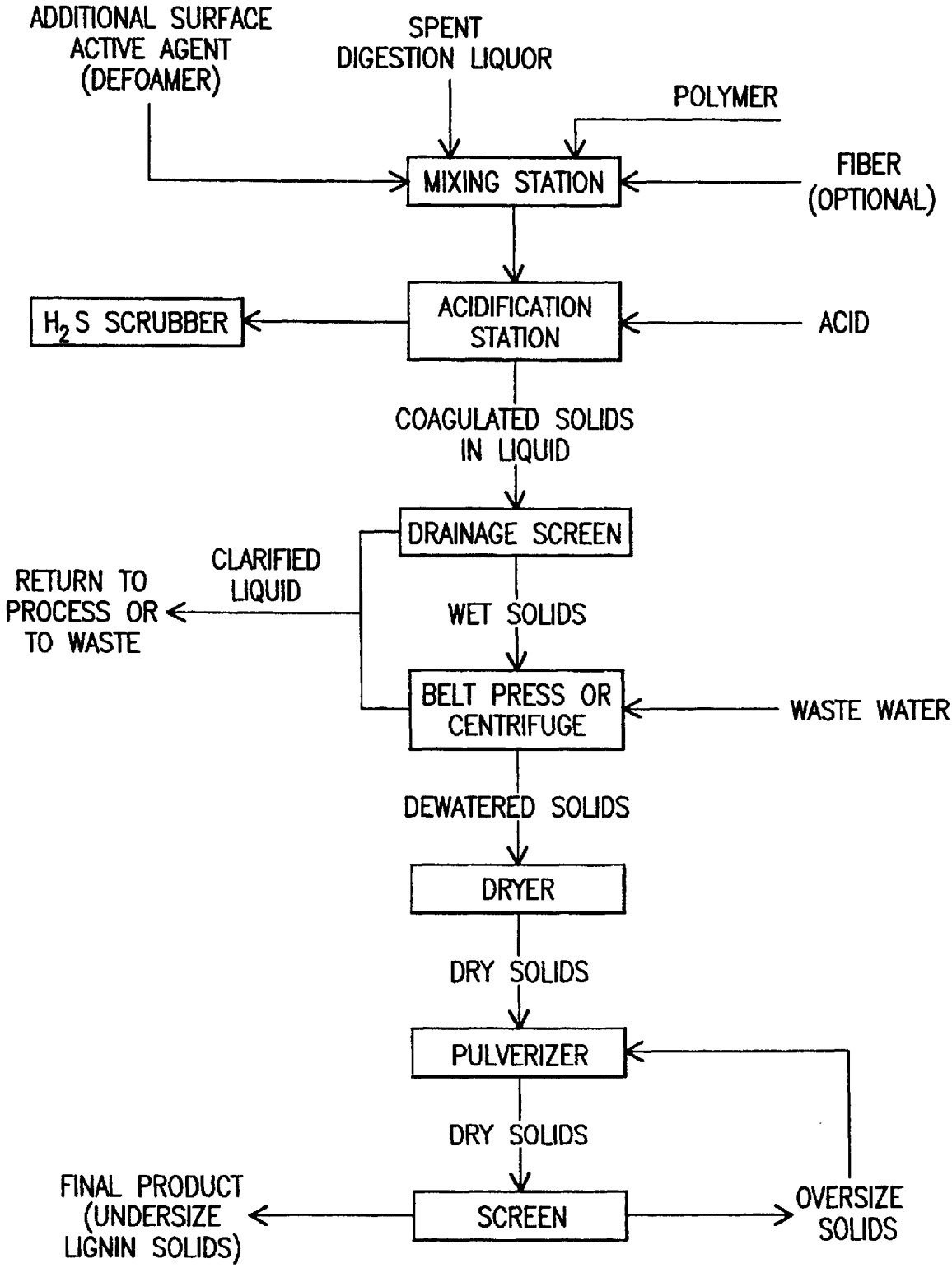

PROCESS FOR TREATING SPENT, WASTE, ALKALINE DIGESTION LIQUOR FROM PAPER PULPING OPERATIONS AND PRODUCT

RELATED APPLICATION

This is a continuation-in-part of application Ser. 08/109,241, filed Aug. 20, 1993, now U.S. Pat. No. 5,635,024.

BACKGROUND OF THE INVENTION

1. Field

This invention is in the field of paper making, specifically in the treating of alkaline digestion liquor for separating contained lignins and other component solids from the liquid component of the normally waste, spent digestion liquor resulting from the production of paper pulp used in the manufacture of paper.

2. State of the Art

Paper making requires a source of cellulose fibers. Common raw materials as a fiber source are hardwoods and softwoods as well as those of annual vegetable origin, such as wheat and rice straw, bagasse (sugar cane stalks after processing), hemp, and jute. Rag materials, an well as recycled fibers, can also be used. However, wood has been a primary source of cellulose fibers for paper making.

Before use, the wood or other raw material must be processed to release the cellulose fibers. This operation is called "pulping". At present, commercial pulping operations are of three principal types: mechanical, full chemical, and semichemical. The processes with which the invention is concerned are full chemical and semichemical pulping.

Full chemical and semichemical pulping employ chemical reagents to effect separation of the cellulosic fibers from other components. Wood chips or other raw materials are cooked with suitable chemicals in aqueous solution, usually at elevated temperatures and pressures. The object is to dissolve the organic binders holding the cellulosic fibers, termed "lignins", comprising up to 26% of wood, for example, along with other types of organic molecules, such as saceharide molecules, and other extraneous compounds, leaving the cellulose fibers intact. Though there is some cellulose degradation, the objective can be realized to a commercially satisfactory degree through the use of a variety of chemical reagents. Pulp yields from wood using such processes are usually about 50% of the wood weight.

Lignins have been studied extensively and are said to consist of the noncarbohydrate portion of the cell walls of plant materials. Originally, the lignin content of plant materials was defined as the residue after hydrolysis with strong acid following removal of waxes, tannins, and other extractives, including resins and tall oils. Lignins are amorphous, have high molecular weight, and are predominantly aromatic in structure. In general, the monomeric units comprising lignins can be referred to as p-hydrocycinnamyl alcohols. More specifically, according to The Merck Index, lignins comprise coniferyl, p-coumouryl, and sinapyl alcohols. Their precise composition vary with the method of isolation and with the species, age, growing conditions, etc., of the plant. Lignins are more or less completely removed by chemical pulping, but are essentially not removed at all by mechanical pulping.

Digestion liquors obtained from alkaline pulping usually contain not only all the lignins in the source material, but substantial amounts of cellulose or carbohydrate monomers, other carbohydrates, and, from annual plant materials, such as rice straw, a significant percent by weight of silica. Such used or spent digestion liquors, normally waste, pose problems that are unique in alkaline pulping operations. waste liquor streams from other operations during the paper making process pose different problems, such as removal of the resins and tall oils found in gymnosperm trees.

The lignin solids precipitate when the spent alkaline digestion liquid is acidified and pose a particular problem, because they are polymerized by acidification, producing an amorphous gum (see The Merck Index, p. 864, (1989), S. Budavari, Editor). No easy, inexpensive, or commercially practical method of separating the lignins from the alkali waste liquors has heretofore been known.

Soda and sulfate pulping are both known in the art as being alkaline pulpinq processes. The soda process employs caustic soda (sodium hydroxide), whereas the sulfate process employs sodium sulfide in addition to caustic soda. The sodium sulfide used in the sulfate process results in a stronger cooking liquor and accounts for stronger pulp and faster cooking in the sulfate process as compared with soda pulping. The term "kraft pulping" is an alternative to the term sulfate pulping. For the purposes of this invention, there is no practical difference between the lignin-laden, spent liquors that result from either the sulfate or the soda process or from semichemical or other pulping processes which make use of alkaline agents in conjunction with mechanical means to make pulp, except there is often a relatively great amount of silica in soda process digestion liquor as compared with sulfate (kraft) process digestion liquor. The common link between pulp-making processes with which the invention is concerned is that spent digestion liquors employing alkali, whether buffered or not, become laden with solids and with organic matter, usually referenced to as total organic carbon [TOC], primarily lignins, and that both the inorganic and organic constituents must be recovered or otherwise processed to accommodate environmental concerns as well as to recycle inorganic digestive chemicals. All cooking or pulping reagents employing alkali, especially caustic soda and sodium sulfide, are expensive and the inorganic waste materials are usually too toxic to release spent liquor to the environment.

The sulfate, i.e., kraft, process and the semikraft process are normally used when wood is the raw material. The active pulping ingredients, sodium hydroxide and sodium sulfide, make up an obviously strongly alkaline solution. Standard in the kraft pulping process is the provision of a liquor-recovery cycle in which the organic constituents in the spent digestion liquor (primarily residual lignins and carbohydrates) are burned for steam generation and for recovery of the inorganic, alkaline, pulping chemicals in molten form, they being then solubilized by the addition of water to form so-called "green" liquor, which is further processed for reuse.

The traditional waste digestion liquor recovery cycle applied most frequently to kraft or semikraft process digestion liquors comprises the step of evaporating digestion waste liquor, the so-called "black liquor", to a high concentration, i. e., to so-called "concentrated black liquor" or "black kraft liquor", which is usually up to 70% solids by weight. Organic sulfur compounds are found in the black liquor from the sulfate process in association with sodium sulfide ($Na_2S$). Sodium carbonate ($Na_2CO_2$), sodium sulfate ($Na_2SO_4$), and silica ($SiO_2$) are also present. Total solids are usually about 15 percent by weight in black liquor after separation from fiber pulp following digestion.

The term "black liquor" is often also applied to other lignin-laden, used or spent digestion liquors, the compositions of which vary with the reagent chemicals used, the raw material, and the particular mill concerned.

The soda process is normally applied to raw materials of annual vegetable origin, such as cereal, e.g. wheat and rice, straw. Such materials normally contain a relatively high percentage of silica, which is solubilized in the digestion liquor. This poses additional separation problems, because, as well known in the art, separating out silica by acidification of the alkaline spent digestion liquor produces a gelatinous or gummy mass that cannot be separated from the liquor in a practical manner. The elevated silica content of liquor derived by pulping such fiber sources, as much as one percent by weight, as compared to the relatively low silica content from wood fiber sources, generally precludes practical application of separation and recovery methods presently known to those skilled in the art.

In the usual kraft recovery process in which silica is a negligible factor, after the black liquor is evaporated to about 70% by weight solids, other procedures, such as vacuum flashing, may be performed to increase even more the preparation of solids for burning. The high-solids-content, kraft black liquor is fed into a reducing recovery furnace provided as part of the usual kraft pulping plant for chemical and energy recovery. The usual reducing recovery furnace requires a large capital investment, and its capacity frequently limits production from a typical kraft pulping plant.

David M. Whalen described a simple method for precipitating lignin from kraft black liquor in Vol. 58, No. 5, May 1975, of the TAPPI Journal, pages 110–112 (see also Whalen et al. U.S. Pat. No. 3,546,200 of Dec. 8, 1970). In that method, kraft black liquor is added slowly and with stirring to a mixture of an organic liquid, such as chloroform, and enough mineral acid to bring the final pH to about 3. The process was successful on a laboratory scale, but the large amounts of organic liquid required made the process impractical on a commercial scale. A more efficient way of separating out the organic constituents, primarily lignins, is still needed.

SUMMARY OF THE INVENTION

In making the present invention I have realized that, with a better way of separating out the lignins from the usual digestive liquor, prior art kraft-pulp-producing plants with their high cost recovery furnaces, can still be used in the normal way, but a significant advantage can be achieved, because pulp production from such a plant is not limited by what the recovery furnace can handle. Instead, the excess spent digestion liquor can be processed in accordance with the invention which does not require that the capacity of the standard recovery furnace be increased.

Thus, it was a principal object of the invention to provide a better way of separating out the lignins from the usual spent and waste digestion liquor.

This objective has been accomplished by the addition of a relatively inexpensive, water soluble, surface active, polymeric agent, sometimes referred to hereinafter as "polymer", to the spent, waste, alkaline digestion liquor before or during the acidification of such digestion liquor and is applicable to the spent, waste digestion liquors from both the commonly used kraft sulfate process and the soda process, whether or not diluted and without the use of heat or pressure.

The polymers used have molecular weights ranging from about five million to about twenty-five million, and may be anionic polymers, such as copolymers of acrylamide and acrylic acid (or sodium acrylate), or partially hydrolyzed polyacrylamide and homopolymers or copolymers of sulfonic acid and acrylamide, which are available as commercial products, such as Percol 919 and Percol 156 from Allied Colloids, Inc., and Nalco 7877 from Nalco Chemicals Company. On the other hand, they may be nonionic polymers based on polyacrylamide chemistry or polyethylene oxides, such as Percol 351, Percol 802, and PEO (polyethylene oxide) available from Allied Colloids, Inc.; or may be cationic polymers of different charge densities, such as Percol 368, Percol 292, and Percol 2802. Nonionic polymers are preferred.

The polymer or a mixture of polymers is added in an amount to bring concentration thereof towithin the range of about 0.05% to about 1.0% by weight in the liquor. To achieve such percentage range, the polymer or mixture of polymers is added in amount from about 0.1 to about 5.0 pounds/ton of dry organic material in the digestion liquor. The preferred level of addition is about one pound per ton.

As the acidification of such digestion liquors can lead to the generation of gases, depending on the alkaline salt used in the pulping process, it is preferred to add a different water soluble, surface active agent, or combination of agents, of low molecules weight, such as a fatty acid or soap of fatty acid, a polysilicone, or a succinate, which has a carbon chain containing from about eight carbon atoms to about eighteen carbon atoms, primarily to enhance the action of the polymer, but, incidentally, to control foaming. It has been found that the presence of such an agent in the range of from about 0.01 to about 1.0 pound per ton of the spent digestion liquor treated has a significant beneficial effect in separation of solids or near solids from the liquid component of the digestion liquor. The preferred level of addition is in the low range of about 0.1 pound per ton of the liquor. The result is the recovery of a substantially clear or very low colored liquid component of the original digestion liquor, which "clarified" liquid is essentially free of dissolved, higher molecular weight, organic solids (primarily lignins and dissolved carbohydrates). Total organic carbon (TOC) in the clarified liquid may be as low as about 0.01% by weight.

Addition of the indicated other surface active, or defoaming, agent to the digestion liquor prior to acidification produces superior results. A clarified liquid component having a residual total organic carbon content on the order of about 0.02 to about 0.01% by weight can easily be achieved. This residual TOC represents a small amount of simple carbohydrate and a very, very small amount of residual lignins if any.

After the water soluble, surface active, polymer and the additional surface active agent, or defoamer, are in place, the digestion liquor is acidified to a pH below 7, preferably to at least about 3. The lignins agglomerate and at least tend to float to the top of the liquor as a non-gelatinous, non-gummy, solid fraction. The higher the solids concentration of the digestion liquor, the greater the tendency of the coagulant to float or to actually float at the surface of the liquor. There, the lignins can be easily separated by mechanical, gravity separation, as by screening the upper portion of the liquor or by filtering. In a spent digestion liquor not as concentrated, where the solids concentration is less than about 15% by weight, the lignins still coagulate, i.e., they form a non-gelatinous, non-gummy solid fraction, but neither fall out of the liquor nor actually float on top. In this condition, i.e., tending to float, they can still be separated by a mechanical, gravity separation step, such as filtration.

The removed solids are washed for removal of residual salts and are thereafter dewatered and dried. At no point does the process result in a slimy gelatinous mass or amorphous gummy fraction of acid lignins or of acidified silica, as has previously occurred upon acidification of black liquor of either the kraft or the soda process. Moreover, by the process of this invention, a significant advantage is achieved by using the aforedescribed procedure as an alternate method of treating excess digestion liquor produced by the usual kraft pulping plant when operated at over the design capacity of the recovery furnace for handling the residual solids to derive energy and recover chemicals therefrom. Instead of requiring the expenditure of large sums to expand the capacity of the recovery furnace of an existing kraft processing plant, excess production of waste digestion liquor can be handled by the present process and by use of a relatively inexpensive supplemental furnace, such as a fluidized bed furnace, as an economically acceptable capital investment. After separation of the solid fraction from the liquid fraction of the diverted waste digestion liquor, the clear residual liquid component is returned to the flow stream entering the plant. This means that the usual recovery furnace of the kraft pulp processing plant need not be the limiting factor in pulp production for existing sulfate (kraft) processing plants.

In the soda process, inorganic chemicals dissolved in waste digestion liquor would normally not be further processed. However, lignins with silica dissolved in the waste liquor are separated together to produce a solid product, having value, and a waste liquid that can be safely returned to the environment.

THE DRAWINGS

The best mode presently contemplated for carrying out the invention commercially is illustrated in the accompanying drawings, in which:

FIG. 1 is a schematic flow sheet showing, in general, steps preferably employed in performing the basic method of the invention; and FIGS. 2–5 are graphs showing results of respective tests of the process of the invention using acidification at different pH values.

DETAILED DESCRIPTION OF THE ILLUSTRATED EMBODIMENTS

The details as to which water soluble, surface active, polymeric agents are preferred and how much should be added to a quantity of spent digestion liquor for best results are presented above and will not be repeated here. However, it will be apparent to those skilled in the art that selection of the preferred polymer and the amount to be used will depend on the source of the lignin, i.e., on the particular raw material being pulped and to the particular process employed. For example, for hardwood and the kraft pulping liquor employed, the nonionic polymer PERCAL 351, available from Allied Colloids, Suffolk, Virginia, is superior. Other kraft pulping liquor, as from softwoods, and soda pulping liquor, as from cereal straw, may require use of different polymers and different amounts thereof depending on the particular raw material being pulped, the degree of chemical and of mechanical pulping, and other considerations known to those skilled in the art.

Turning to the drawings, the flow sheet of FIG. 1 illustrates in general a preferred embodiment of the basic process of the invention for treating spent, waste digestion liquors and is indicative of the lignins -and other products recovered therefrom.

The spent digestion liquor laden with lignins is passed into a mixing station where the polymer is added and preferably also the additional surface active, or defoaming, agent. This station can be a static station or a continuous flow type. Optionally, but preferably, fiber is added as well to aid coagulation (formation of the solid fraction) and its separation from the remaining liquid fraction.

From this station, the conditioned liquor is passed to another station for its acidification with an acid, preferably sulfuric acid or phosphoric acid. Organic acids may be used in combination with mineral or inorganic acids as may be appropriate for process needs. Hydrogen sulfide gas will be generated upon acidification if sodium sulfide is contained in the alkaline salt used for pulping. Preferably, this station is enclosed and has conducting means for conducting such gas to a hydrogen sulfide gas scrubber, as indicated. Upon acidification, particularization (coagulation into smaller or larger aggregations) of the lignins also commences. These tend to float to the surface of the spent digestion liquor, but when the lignin concentration is high, as when there is a total solids concentration in amounts of around 15% or above, they actually float and can be screened off and into a dewatering station, such as a drainage belt. Much of the liquid is separated from the solids by passing through the apertures of the drainage belt. The dewatering station preferably further includes a belt press or centrifuge, where even more liquid is removed. A fresh water wash can be used to displace salts carried in the solids. The liquid removed at the dewatering station is preferably passed to an evaporator.

Depending on the concentration of lignins as reflected in the total solids concentration (TSC), the exact nature of the separable, particulate, solid fraction, primarily lignins, that form varies. As used herein, the term "particulate" refers generally to the constituent particles of the solid fraction. The non-gelatinous, non-gummy condition of these particles, i.e. solid fraction that forms in the liquid fraction after treatment according to the invention, is readily separated by gravity from the clarified liquid fraction. In lower concentrations of the digestion liquor, the particulate matter agglomerates and stays suspended in the clarified liquor solution, tending to float. It remains suspended in the clarified liquid fraction. As used herein, the term "coagulate" also refers to this formation of a readily separable, insoluble, particulate, solid fraction that tends to float. In any event, one of the advantages of the invention is that in two or three steps consisting of the addition of polymer, with or without the addition of the indicated defoamer, in conjunction with or preferably followed by acidification, is that an insoluble non-gelatinous, non-gummy particulate solid fraction is substantially instantaneously produced and either tends to float or if the concentration of the digestion liquor is high, actually does float at the surface of the liquid fraction. No other operating parameters, such as temperature, pressure, or shearing forces, are necessary.

If phosphoric acid is used for acidification, crystallization is preferably employed to separate a crystallized salt, such as disodium phosphate, which can be sold. Steam given off from the evaporator can be put to use. The liquor clarified of lignins is preferably evaporated to a salt concentration of 35% to 40% and is returned to the process.

One measure of efficiency of separation is indicated by the percent TOC in the remaining liquid fraction. A low TOC value, known in the art to be expressed as percent by weight, indicates all organics are removed except for residual, low molecular weight, soluble organic compounds that are not ordinarily subject to precipitation. A high TOC value indicates precipitatable solids remain in the liquid fraction after a treatment process and the separation is incomplete and inefficient to a certain degree. Values of percent TOC by weight above 0.2 (undiluted) in the supernatant liquor in treating kraft or other digestion liquor can be considered indicative of less than optimal separation. Color and clarity of the remaining liquid fraction are also indicative of completeness of removal of lignins. Ideally, it should be clear and substantially colorless or a very pale yellow.

Highly efficient separation of less concentrated, spent digestion liquors, i.e., TOC values of about two percent or less, and the presence of silica, are dependent upon the order of addition in the treatment, that is, by adding polymer solution and the indicated other surface active agent, or defoamer, to the spent digestion liquor prior to the acidification. This order of addition results in separation of lignins and other organic components as agglomerated masses easily separable from the clarified digestion liquor by simple mechanical, gravity separation methods, such as screening, belt-pressing, centrifugation, and filtration.

The separated solid fraction can be subjected to various dewatering processes with efficiency and ease heretofore unknown in the prior art by commercially feasible and inexpensive separating procedures. Again mechanical gravity separating procedures for dewatering the separated solid fraction include screening, belt pressing, centrifugation, and filtration. The much improved efficiency of such procedures over the prior art is shown by the ease with which the solid fraction can be air dried. A further advantage of the invention is that the air dried, solid fraction is of very low moisture content compared to the lignin-containing solid fraction of the prior art. After air drying, the solid fraction can have a moisture content as low as 5% by weight and is ready for shipment or for use as a fuel. Once dried, the lignins may be passed through a pulverizer and screened. Undersize lignins can be used as fuel. Oversize lignins can be passed through the pulverizer again.

Initially, the process of the invention was evaluated by obtaining two identical samples of a concentrated kraft digestion liquor. One was acidified with sulfuric acid after treatment with the polymer. The other was acidified in the normal manner as a control without the polymer. It was noted that the precipitate that formed in the polymer-treated sample coagulated and floated to the top and was easily separated from the clarified liquid component of the digestion liquor. The precipitate in the untreated sample was in a slimy, gelatinous form and was not easily separated. In addition, the polymer-treated sample produced 75% more dried precipitate than the control sample.

The following table shows the organic and inorganic (ash), as well as total solids distribution between precipitate and filtrate for both samples:

Table Showing Component Distribution Between Precipitate and Filtrate in Comparative Tests

| | Control | Polymer-treated |
|---|---|---|
| | Precipitate | |
| % of Total Organics | 44.4 | 63.7 |
| % of Total Ash | 13.1 | 20.0 |
| % of Total Solids | 30.1 | 46.9 |
| | Filtrate | |
| % of Total Organics | 55.6 | 36.3 |
| % of Total Ash | 86.9 | 80.0 |
| % of Total Solids | 70.0 | 53.1 |

Additional tests were performed as in the following example:

EXAMPLE 1

Treatment of Concentrated Kraft Liquor with Polymer Followed by Acidifying

Spent digestion liquor from a kraft pulping process was diverted after its separation from fiber on a washing drum, the composition factors being total organic carbon (TOC) of 7.9 percent and pH of 12.3. While at ambient temperature, polymer solution was added in an amount yielding about 30 ppm of the polymer in the liquor. The mixture was then acidified with sulfuric acid, causing the formation of a solid precipitate containing primarily lignins, which floated to the surface of the residual liquid as non-gelatinous, non-gummy, agglomerated masses of coagulant. These masses of precipitated solids were then easily separated from the clarified liquid by filtering, but could not be separated by screening. Analysis revealed 2.15% TOC in the clarified liquor fraction.

EXAMPLE 2

Treatment of Concentrated Kraft Liquor with Polymer and Another Surface Active Agent, Defoamer, Prior to Acidification Digestion liquor was diverted from the same source as in Example 1 and was treated at ambient temperature by simultaneously adding the same amount of the same polymer solution plus a fatty acid at two parts per 1000 parts of the liquor. After one minute of standing, the liquor was acidified to a pH of 3.5 to 4.0 with 50 percent strength sulfuric acid added slowly over a period of one minute. Lignin solids in the acidified liquor similarly formed non-gelatinous, non-gummy, agglomerated masses which floated at the surface of the residual liquid, but were readily separated from the liquid fraction on a 10 mesh screen. The clarified liquor fraction was clear and almost colorless. Analysis revealed 0.17 percent TOC.

EXAMPLE 3

Treatment of Dilute Kraft Digestion Liquor with Polymer

Digestion liquor was again diverted from the same source but was diluted with an equal quantity of tap water. The composition of the diluted liquor was approximately 7.5% solids and 3.9% TOC with a pH of about 12.3. To this dilute liquor at ambient temperature, the same polymer solution as in the foregoing examples was added to bring the amount of polymer in the diluted liquor to 30 ppm. After one minute of standing, the mixture was acidified to a pH of 3.5 to 4.0 with 50 percent strength sulfuric acid again added slowly over a period of one minute. Lignins therein formed a non-gelatinous, non-gummy, suspended, particulate solid fraction that was readily filtered from the remaining liquid fraction. The clarified liquid, was clear and almost colorless. Analysis revealed 0.80 percent TOC.

EXAMPLE 4

Treatment of Dilute Kraft Digestion Liquor with Polymer and Defoamer Surface Active Agent Dilute spent digestion liquor at ambient temperature diverted from the same stage of an alkaline pulp-making plant and of the same diluted composition as that in Example 3 was treated by adding enough polymer solution to bring the amount of polymer in the mixture to 30 ppm and simultaneously adding a fatty acid to bring its amount two parts per 1000 parts of the mixture. After one minute of standing, the liquor was acidified to pH of 3.5 to 4.0 with 50 percent strength sulfuric acid added slowly over a period of one minute. A solid fraction containing lignins was formed characterized by large masses of agglomerated coagulant that readily separated from supernatant liquid on a 10 mesh screen. The liquid fraction after screening was clear and almost colorless. Analysis revealed 0.10 percent TOC.

From the foregoing examples with respect to kraft digestion liquor, it can be seen that when a surface active defoamer agent is added, the coagulant flocs produced during co-precipitation stick together as a separable mass. Conversely, when the defoamer surface active agent is not employed, a finer, particulate, solid fraction is formed that cannot be separated by a 10 mesh screen, but is nevertheless easily separable by filtering. Such solid fraction is neither gelatinous nor gummy, as are precipitated fractions obtained by prior art methods. The beneficial effect of the additional surface active defoamer agent is the formation of screen-separable, lignin-containing, coagulant masses. Screening is more efficient than filtration, and is an unexpected result from the apparent co-precipitation action of the two surface active agents. Furthermore, the differences in TOC between Examples 1 and 2, and again between Examples 3 and 4, show substantially improved separation by use of surface active defoamer agent.

The following example with respect to soda digestion liquor shows how the process of the invention similarly eliminates the prior art gelatinous nature of the lignins solids, despite the high silica content of the soda digestion liquor.

It has also been found that, upon addition of polymer to spent soda digestion liquor containing a considerable amount of silica, followed by acidification to a pH of about 3 in accordance with the invention, a suspended, particulate, solid fraction and a residual, clarified, liquid fraction are formed. The particulate precipitate is a combination primarily of lignins and silica. Heretofore, silica-laden, spent, digestion liquor of the soda pulping process posed difficult separation and waste disposal problems. However, the combined precipitate of lignins and silica obtained by the herein disclosed process is substantially as readily separable as the precipitate obtained from the low silica content, kraft digestion liquor. This represents a further unexpected result and a further advantage of the invention.

The following example is typical:

EXAMPLE 5

Treatment of Spent, Semi-Chemical, Soda Digestion Liquor from Pulping a Cereal Straw Material A sample of waste digestion liquor was obtained from a semi-chemical, soda pulping process. Its measured composition was about 15 percent by weight solids and 3.7 percent by weight TOC at a pH of 12.3. Silica content was determined by analysis to be 144 parts per million by weight in the liquor. While at ambient temperature, a polymer solution was added in amount to produce 30 ppm in the liquor; subsequently, after one minute of standing, the polymer-treated liquor was allowed to flow into a flume simultaneously with recycled, clarified liquor to which 50 percent strength sulfuric acid had been added such that the pH of the clarified liquor was in the range of 3.5 to 4.0. Lignins and silica were separated as non-gelatinous, non-gummy, agglomerated coagulant solids in a receiving vessel into which the mixed liquor flowed. The supernatant liquid component from filtering was clear and almost colorless, with 0.04 percent TOC and a silica content of only 15 parts per million by weight.

The clear and low coloration, clarified liquid from the process of the invention is a novel product comprising the salt ions formed as a result of interaction of the original alkali charge and the added acid, in the range of about 3% to about 0.01% TOC by weight, depending on the starting spent liquor and the procedures employed in clarification.

Likewise, the recovered lignin-containing, solid fraction product is unique. The dewatered solid fraction comprises lignins, polymer, and, if employed in the recovery process, the added surface active defoaming agent, as well as some or considerable silica. The amount of silica may be great depending on the source material used. Besides the usual substances found in lignins isolated by prior art methods, the dewatered, air dried lignins as the solids fraction of the invention contains from about 0.05 percent dry solids (or about 500 parts per million) polymer. If the additional surface active defoaming agent is used, the lignins-containing, solids fraction will contain from about 0.0005 percent to about 0.05 percent by weight of such additional agent. The dewatered and dried solids fraction, if air dried, has a moisture content in the range of about 5.0 percent to about 10.0 percent by weight. If dried by heating, the solids fraction has a moisture content in the range of about 1.0 percent to about 3.0 percent by weight.

Operating parameters for adapting the method disclosed herein to the characteristics of particular alkaline waste digestion liquors diverted from various stages of pulp-making are well within the skill of those practiced in the art of pulp-making. Some digestion processes are carried out at higher alkalinity levels, and the degree of digestion may be less severe, i.e., the percent of dissolved solids less, such as with semi-chemical pulping where mechanical separation of fibers from the raw material is occurring simultaneously with chemical separation. "Deepness" as used in the industry refers to degree of digestion, i.e., more severe chemical pulping is referred to as "more deep" digestion and vice versa. Waste liquor from semi-chemical or lesser intensity "deep" chemical pulping can be processed somewhat differently in accordance with the skill of the art guided by the present examples within the scope of the invention.

As previously indicated, the foregoing procedure can be advantageously applied to only a relatively minor part, typically about 10.0 percent by volume, of a kraft digestion liquor from the usual kraft pulping plant equipped with the standard, very expensive, recovery furnace. In the case of spent digestion liquor from a soda pulping plant, all of the digestion liquor would be treated by the present invention. This is so, because in the usual soda pulping process, the resulting digestion liquor is not suitable for processing and no recovery furnace is part of the standard equipment as it is in the kraft pulping plant.

It should be noted that Examples 3 and 4, wherein concentrated black liquor from the kraft process was diluted by the addition of an equal amount of water before processing in accordance with the invention, show somewhat but not greatly different results from those of Examples 1 and 2 in which there was no dilution of the concentrated black liquor, but in which conditions were otherwise quite similar. These examples illustrate the fact that those skilled in the art should apply the process experimentally to individual situations on the basis of their knowledge and skills, thereby determining the best approach so far as particular agents, quantities thereof, and other factors that can be varied for such individual situations are concerned. This also applies to the handling of soda digestion liquors.

Example 5 shows how adjusting physical arrangements for the adding of polymers and for contacting the treated liquor with acid to reduce pH may be significant in achieving efficient lignin and silica separation.

Figure 2:
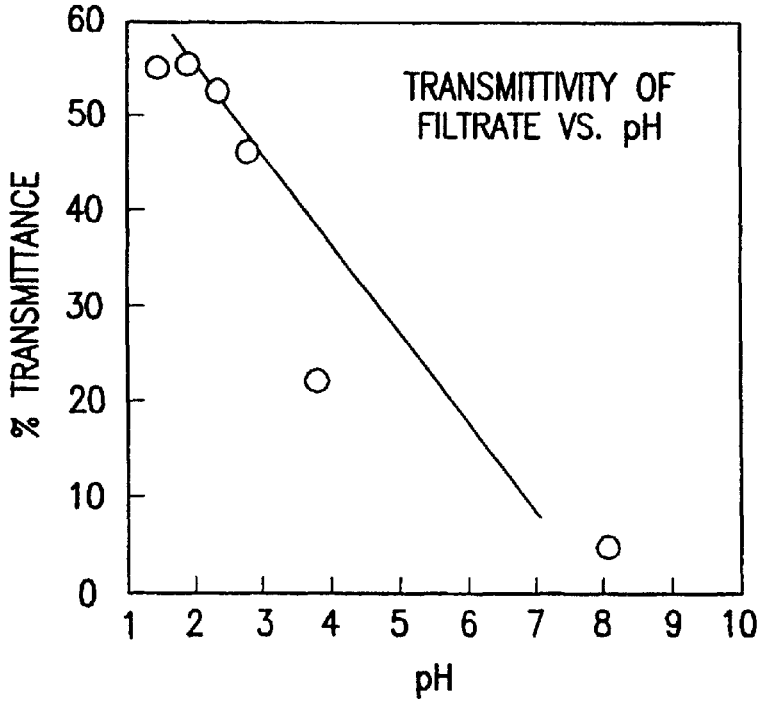
Figure 3:
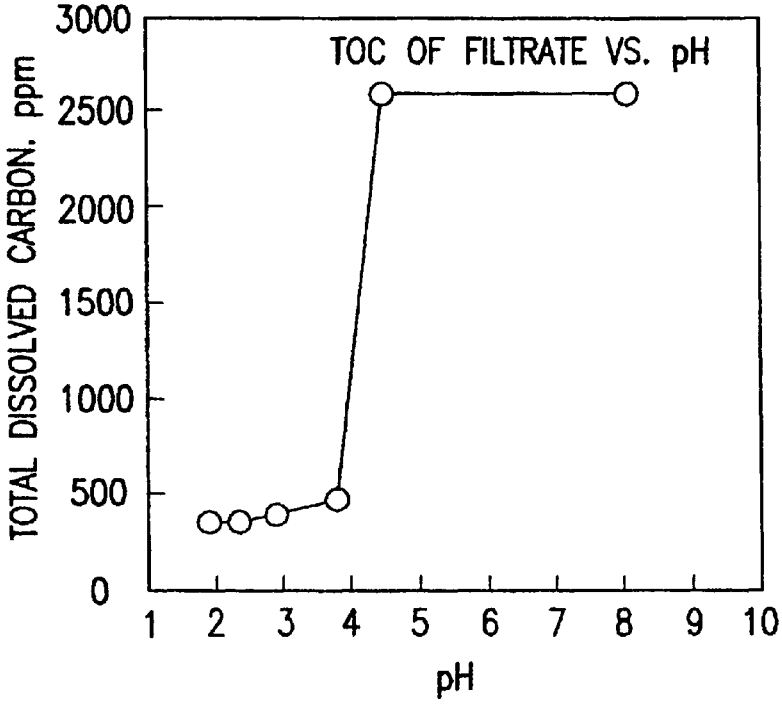
Figure 4:
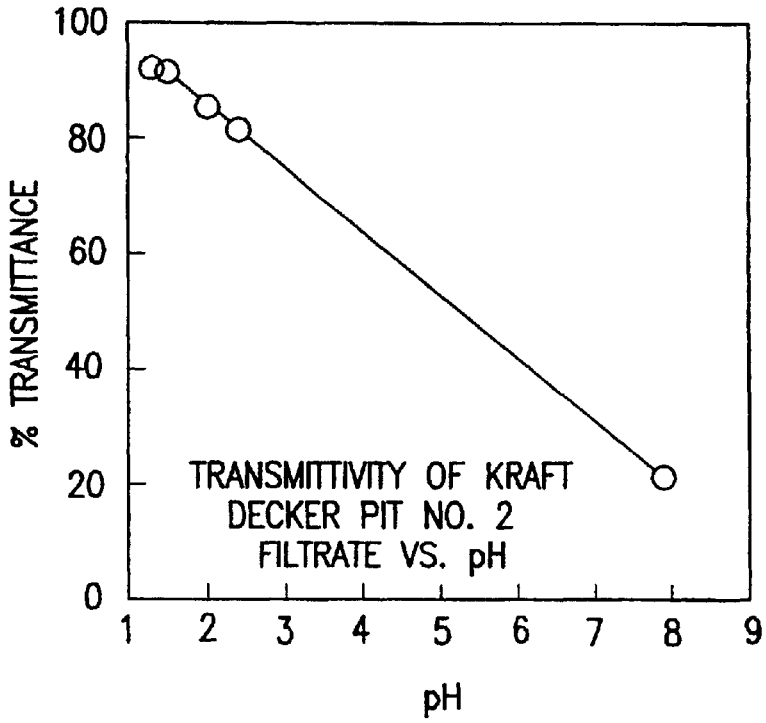
Figure 5:
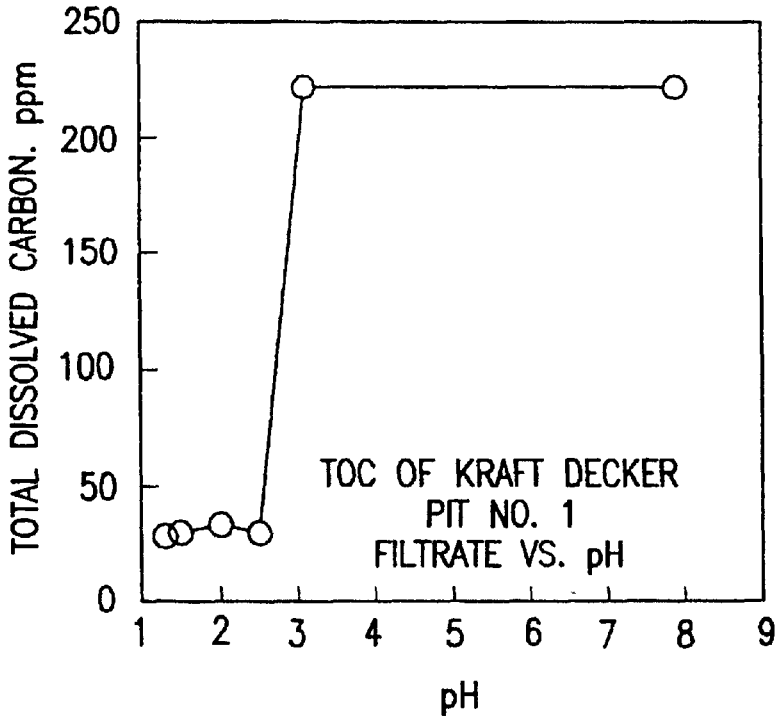

The graphs of FIGS. 2–5, are based on tests made on respective filtrates (clarified liquids) for transmittivity and TOD content vs pH of processed kraft digestion liquors, the liquor of FIGS. 2 and 3 being screen room wash water and that of FIGS. 4 and 5 being dilute waste water, both being derived from waste, spent digestion liquor. Visible light transmittivity was measured in each instance by the use of the same turbidity measuring instrument, a nephelometer. These graphs show that the process can be carried out at various pH values above and below a pH of 3.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A process for treating a substantially spent, alkaline and non-sulphite digestion liquor obtained from a pulping plant of the paper making industry, said digestion liquor containing lignins as potential precipitants upon acidification of said digestion liquor, leaving substantially clarified residual liquid, said process comprising the steps of:

mixing into said spent digestion liquor a water soluble, surface active, polymeric, coagulant agent;

acidifying the so mixed liquor to a pH below 7 to precipitate the lignins and other organic compounds and to coagulate them as solids which tend to float to the surface of the residual liquid; and separating the coagulated solids and the residual liquid, one from the other.

2. A process according to claim 1, wherein a surface active agent coactive with the polymeric, coagulant agent is added to the spent digestion liquor prior to the acidification thereof so as to coact with the polymeric, coagulant agent and thereby facilitate lignin separation.

3. A process according to claim 2, wherein the surface active agent is a water soluble, surface active co-precipitant agent.

4. A process according to claim 1, wherein the spent digestion liquor is taken from a kraft process pulping plant.

5. A process according to claim 4, wherein the kraft pulping plant includes a reducing recovery furnace and the spent digestion liquor taken from said plant is substantially only that produced in excess of what said furnace is capable of handling.

6. A process according to claim 1, wherein the spent digestion liquor in taken from a soda process pulping plant.

7. A process according to claim 6, wherein the soda process digestion liquor has a significant content of silica.

8. A process according to claim 1, wherein the polymeric coagulant agent is added to the spent digestion liquor before acidification of said liquor.

9. A process according to claim 1, wherein the polymeric coagulant agent is added to the spent digestion liquor during acidification of said liquor.

10. A process according to claim 1, wherein the spent digestion liquor is diluted prior to treatment.

11. A process according to claim 1, wherein the solids and the residual liquors are used as valuable products.

12. The solids product resulting from the process of claim 1.

13. The clarified liquid product resulting from the process of claim 1.

14. A process for treating a spent kraft alkaline digestion liquor containing lignins and liquid, comprising the steps of:

(a) mixing into said spent kraft digestion liquor a water soluble, surface active, polymeric coagulant agent;

(b) acidifying the spent digestion liquor of step (a) to a pH below about 3 to cause lignins and other dissolved organic compounds of the spent digestion liquor to coagulate as solids and float to the surface of the spent digestion liquor; and (c) separating the coagulated solids and the residual liquid of the acidified spent digestion liquor, one from the other.

* * * * *